US011278467B2

(12) United States Patent
Moridaira

(10) Patent No.: US 11,278,467 B2
(45) Date of Patent: Mar. 22, 2022

(54) STRETCHING TOOL

(71) Applicant: JUTE INC., Tokyo (JP)

(72) Inventor: Shigeo Moridaira, Tokyo (JP)

(73) Assignee: Jute Inc., Tokyo (JP)

( * ) Notice: Subject to any disclaimer, the term of this patent is extended or adjusted under 35 U.S.C. 154(b) by 320 days.

(21) Appl. No.: 16/334,241

(22) PCT Filed: Sep. 21, 2016

(86) PCT No.: PCT/JP2016/077810
§ 371 (c)(1),
(2) Date: Mar. 18, 2019

(87) PCT Pub. No.: WO2018/055690
PCT Pub. Date: Mar. 29, 2018

(65) Prior Publication Data
US 2019/0224068 A1 Jul. 25, 2019

(51) Int. Cl.
*A61H 15/00* (2006.01)
*A63B 23/00* (2006.01)

(52) U.S. Cl.
CPC ..... *A61H 15/0092* (2013.01); *A61H 15/00* (2013.01); *A61H 2015/005* (2013.01); *A61H 2015/0014* (2013.01); *A61H 2201/0157* (2013.01); *A63B 2023/006* (2013.01)

(58) Field of Classification Search
CPC .... A61H 7/001; A61H 15/00; A61H 15/0092; A61H 2015/005; A61H 2015/0014; A61H 2015/0064; A61H 2201/169; A61H 2201/1269; A61H 2201/1284; A61H 2201/1695; A63B 2023/006
USPC ..... D24/211–215
See application file for complete search history.

(56) References Cited

U.S. PATENT DOCUMENTS

| | | | | |
|---|---|---|---|---|
| D492,791 | S | 7/2004 | Alexander | |
| 9,907,720 | B2 | 3/2018 | Kuhne | |
| D843,592 | S * | 3/2019 | Tsuyama | A61H 15/02 D24/215 |
| D857,129 | S * | 8/2019 | Lim | A61H 15/0092 D21/662 |
| 2006/0089578 | A1* | 4/2006 | Hsu | A61H 15/00 601/118 |

(Continued)

FOREIGN PATENT DOCUMENTS

| | | | |
|---|---|---|---|
| JP | H03-78536 | U | 8/1991 |
| JP | 3202291 | U | 1/2016 |
| WO | 2015/032390 | A1 | 3/2015 |

*Primary Examiner* — Colin W Stuart
*Assistant Examiner* — Douglas Y Sul
(74) *Attorney, Agent, or Firm* — Carrier Blackman & Associates, P.C.; William D. Blackman; Joseph P. Carrier

(57) ABSTRACT

A stretching tool includes: two spheres of identical size, each with a two-layer structure consisting of an inner shell and an elastic outer covering layer which is affixed to the surface of the inner shell and which has a hardness relatively less than that of the inner shell; and a connecting section that connects the inner shells of the two spheres so that an extended axial center line passes through the centers thereof. The spheres' exterior surfaces have ridges that have saw-blade-shaped cross-sections and extend over the extended axial center line continuously from an end section on the outermost side of each of the two spheres toward the connecting section.

9 Claims, 12 Drawing Sheets

(56) References Cited

U.S. PATENT DOCUMENTS

| | | | | |
|---|---|---|---|---|
| 2008/0255484 | A1* | 10/2008 | Gueret | A61H 15/02 601/129 |
| 2009/0131234 | A1* | 5/2009 | Dye | A61H 15/0092 482/132 |
| 2013/0090220 | A1* | 4/2013 | Bertram | A61H 15/0092 482/139 |
| 2014/0024984 | A1* | 1/2014 | Allen | A61H 15/00 601/134 |
| 2016/0074273 | A1 | 3/2016 | Mallory | |
| 2016/0136474 | A1 | 5/2016 | Dye | |
| 2017/0007486 | A1* | 1/2017 | Kuhne | A61H 1/008 |

* cited by examiner

STRETCHING TOOL

TECHNICAL FIELD

The present invention relates to a stretching tool capable of applying pressure to fascia present in a deeper region, while promoting blood circulation with gentle feeling to skins.

BACKGROUND ART

FIG. 9A to FIG. 9B schematically show a conventional stretching tool described in Patent Literature 1; and the former is a perspective view thereof, and the latter is a side view thereof. As shown in these figures, the conventional stretching tool 20 includes: two spherical bodies 21 of identical size, each having a smooth surface; and a coupling portion 22 coupling them to each other. FIG. 10A and FIG. 10B are sectional views showing respective internal structures of conventional stretching tools, each having a similar shape; and the former has a solid internal structure, and the latter has a hollow internal structure.

If the conventional stretching tool as shown in FIG. 9A is formed of a solid material as shown in FIG. 10A, the stretching tool is mainly formed of resin, such as polyurethane and polyvinyl chloride, and is classified into extremely soft or hard one in light of the surface hardness of the tool. One having soft hardness has an advantage in gentleness for skin, so that an excessive load is suppressed from being applied to muscles or joints; but excessive softness rather raises a problem that the tool is easily deformed by the weight of the body, and it becomes difficult to provide sufficient pressing force for exhibiting a stretching effect on the fascia. On the other hand, the one with high hardness is so formed as to aim at a high stretching effect; however, when pressure is applied to the body using this tool, excessive hardness provides too strong stimulation to the skin, which rather hinders a sufficiently effective stretching. In addition, if the body is placed on this tool and too much pressure is applied to the body with its weight, an excessive load is applied to the muscles or the joints; consequently, the muscles or the joints might be injured, which is rather dangerous.

In the case of the stretching tool having a hollow thereinside, as shown in FIG. 9B (see FIG. 10B), in order to maintain its outer shape, the tool is required to be formed of a hard material; and consequently, an excessive load is applied to the skins, the muscles, or the joints.

CITATION LIST

Patent Literature

Patent Literature 1: Specification of U.S. Design Pat. No. D492,791

SUMMARY OF INVENTION

Technical Problem

As aforementioned, in the case of forming the conventional stretching tool from soft material, excessive load is prevented from being applied to skins, muscles, or joints, but sufficient pressure cannot be applied to the body, which raises a problem that a sufficient stretching effect cannot be obtained. In the case in which the tool is formed of an extremely hard material, when the weight is applied onto this tool, skins, muscles, or joints might be injured. In contrast, skins, muscles, or joints are prevented from being injured when the tool is used without applying the weight, but this case raises a problem that sufficient pressure cannot be applied, so that it becomes difficult to exert a sufficient stretching effect.

In addition, the conventional stretching tool has outer surfaces formed into smooth spherical surfaces, so that it is difficult to exert a sufficient massaging effect on a shallow fascia which experiences adhesion and twist and thus becomes stiff, present under the subcutaneous fat.

The present invention has been made in order to solve the above problems, and an object thereof is to provide a stretching tool that provides a sufficient stretching effect on deep fascia while preventing excessive load onto skin, muscles, or joints.

Solution to Problem

In order to achieve the above object, a stretching tool of the present invention is characterized by including: two spherical bodies of identical size, formed in a double structure including inner shells and outer covering layers in tight contact with respective surfaces of the inner shells, the outer covering layers having a relatively smaller hardness than that of the inner shells so as to have elasticity; and a coupling portion coupling the inner shells of the spherical bodies to each other. With this configuration, the spherical bodies are formed in a double structure including the inner shells formed of the material having a relatively high hardness and the outer covering layers formed of the material relatively small and having elasticity, to thereby exert a stretching effect acting on fascia in a deep region.

The stretching tool of the present invention is also characterized by including: two spherical bodies of identical size; and a coupling portion that couples inner shells of the two spherical bodies to each other such that an extending line of an axial center of the coupling portion passes through respective centers of the inner shells of the two spherical bodies, and is formed of a material that is the same as or different from a material of the inner shells, wherein multiple projecting lines are formed on each outer surface of the two spherical bodies, the multiple projecting lines having a cross-section in a saw blade shape including peaks and troughs alternately arranged in respective circumferential directions of the spherical bodies, the projecting lines continuously extending toward the coupling portion from respective outermost ends of the spherical bodies located on the extending line of the axial center. By spirally providing the multiple projecting lines on the outer surface of the outer covering layer, it is possible to promote blood circulation with gentle feeling to the skins and also apply stimulation to shallow fascia present under the subcutaneous fat so as to massage this fascia and thereby exert a high stretching effect.

Advantageous Effects of Invention

In the stretching tool of the present invention, since the two spherical bodies are configured in a double structure in the above manner, while an excessive load is suppressed from being applied to skins, muscles, or joints, a blood-circulation promoting effect can be exerted in a gentle manner.

In addition, in the stretching tool of the present invention, since the multiple projecting lines, particularly the multiple spiral projecting lines are provided on the outer surfaces of the two spherical bodies, it is possible to exert an excellent stretching effect on shallow fascia and/or deep fascia by applying sufficient pressure.

DESCRIPTION OF EMBODIMENTS

Figure 1:
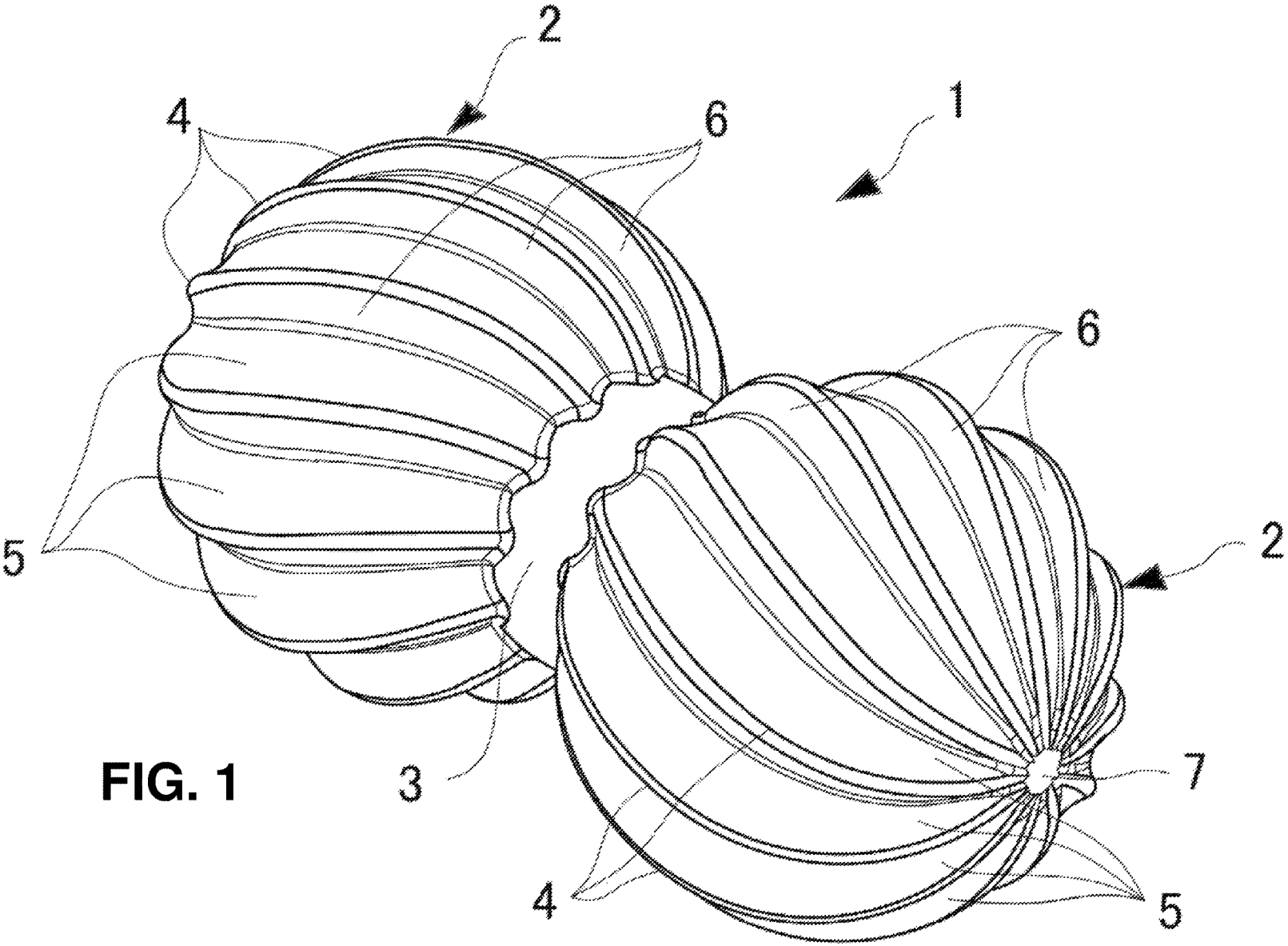
FIG. 1 is a perspective view showing one embodiment of a stretching tool of the present invention.
Figure 2:
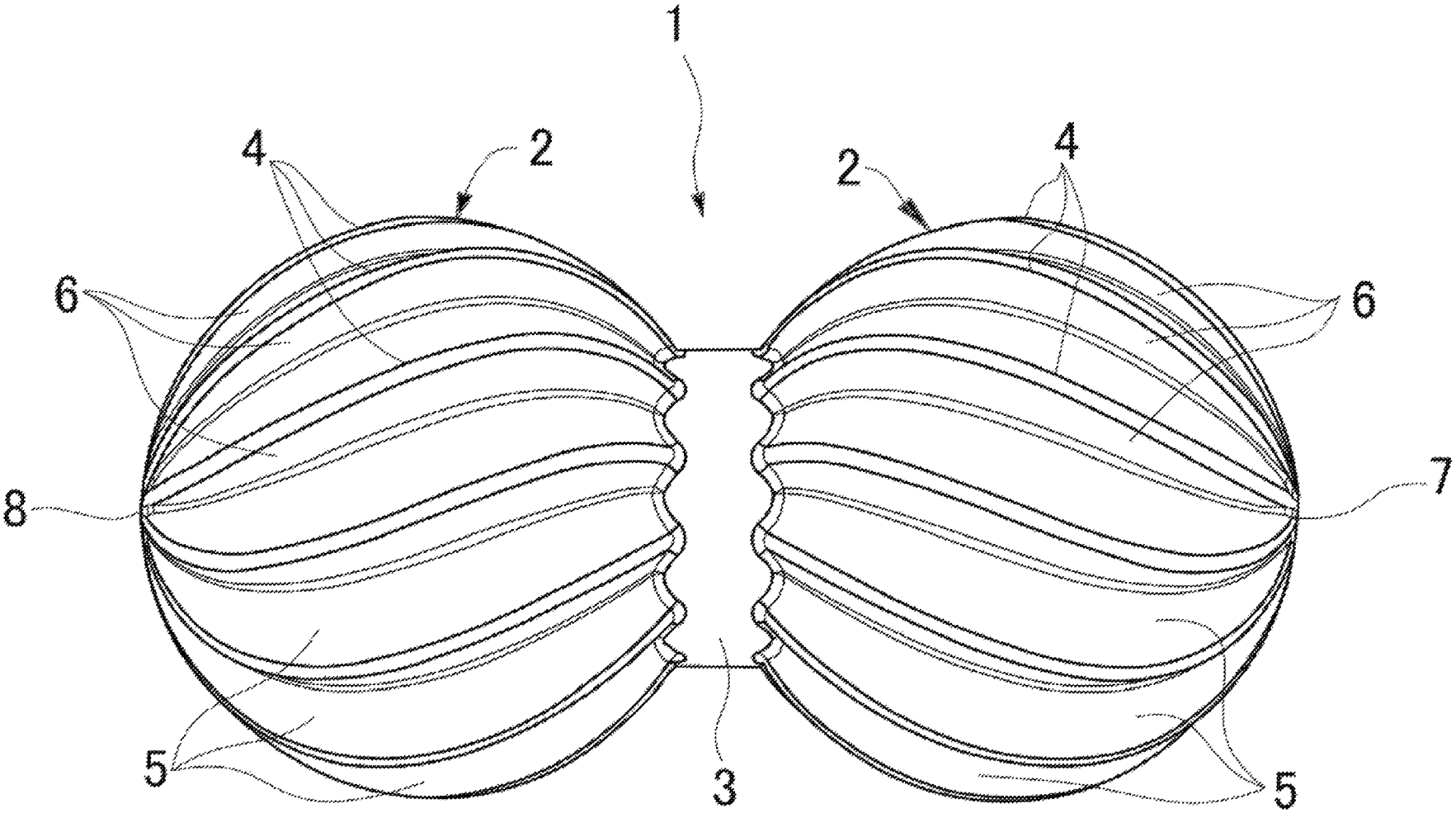
FIG. 2 is a front view of the embodiment shown in FIG. 1.
Figure 3:
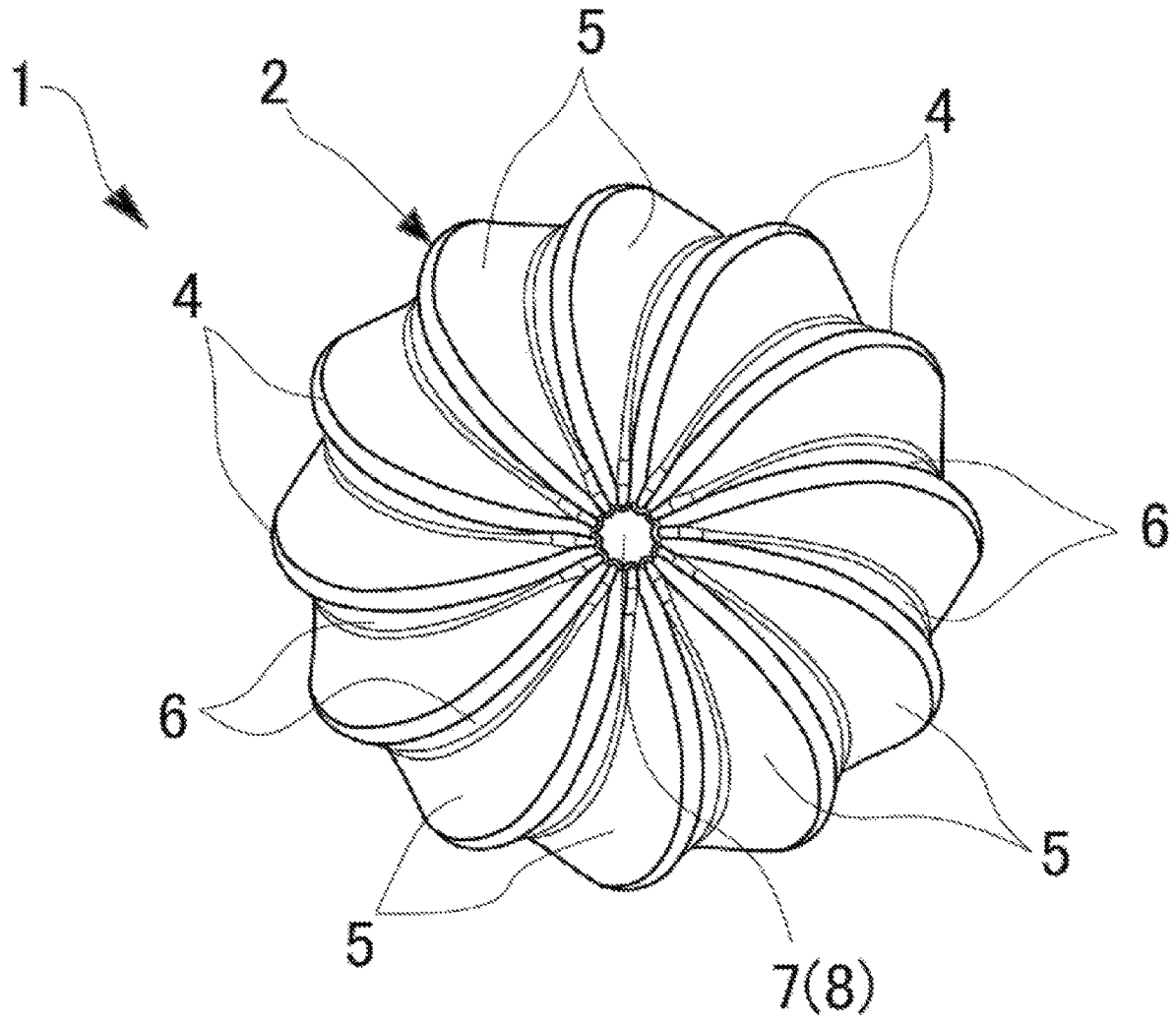
FIG. 3 is a side view of the embodiment shown in FIG. 1.
Figure 4:
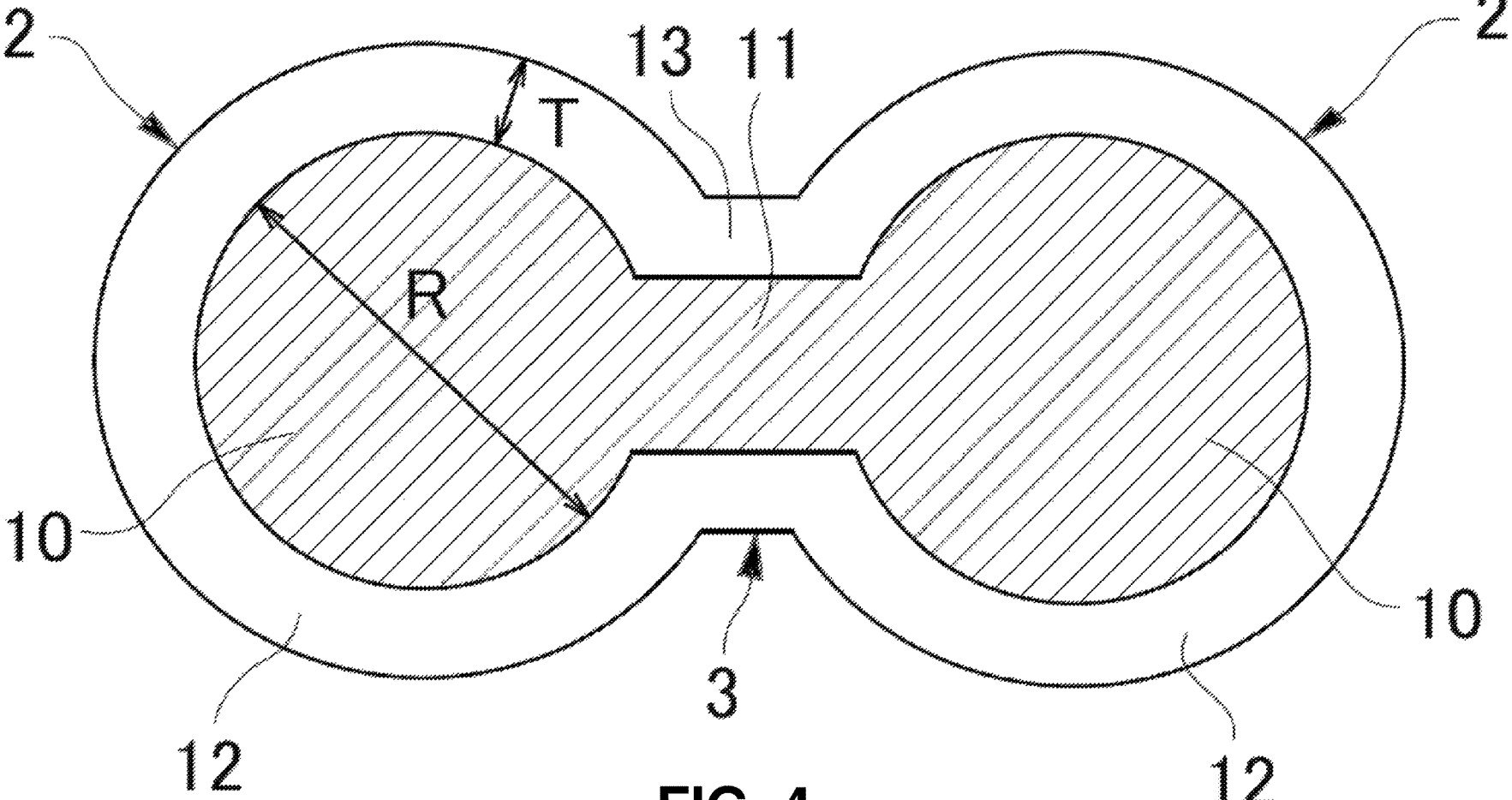
FIG. 4 is a sectional view of the embodiment shown in FIG. 1.
Figure 5:
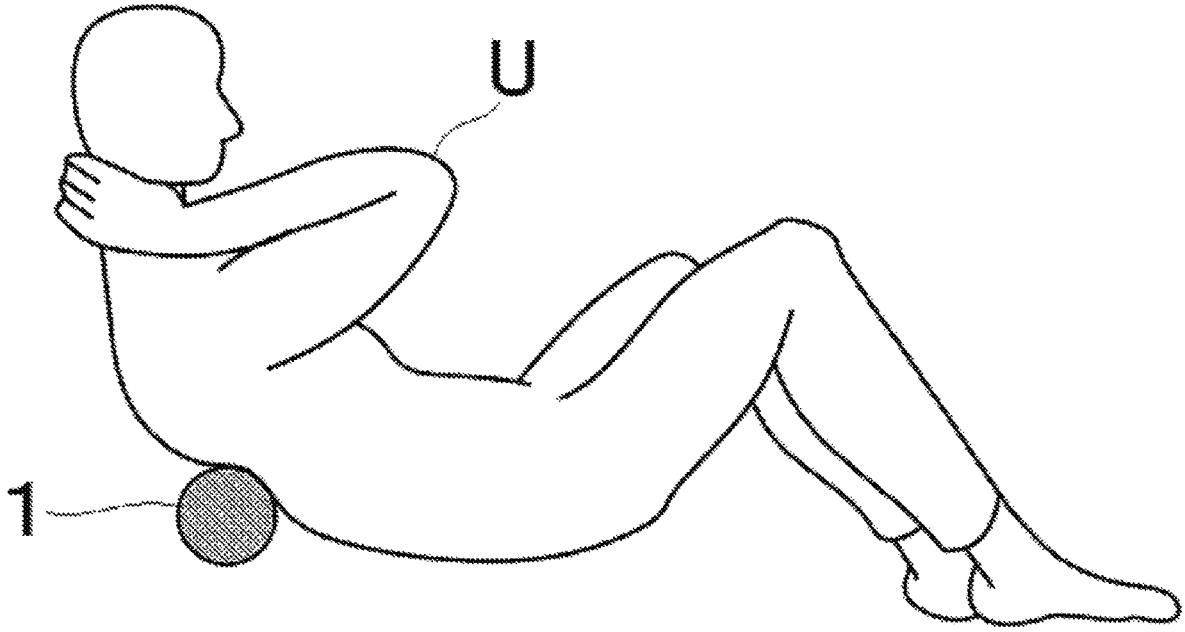
FIG. 5 is a view explaining one example of a usage state of the embodiment shown in FIG. 1.
Figure 6:
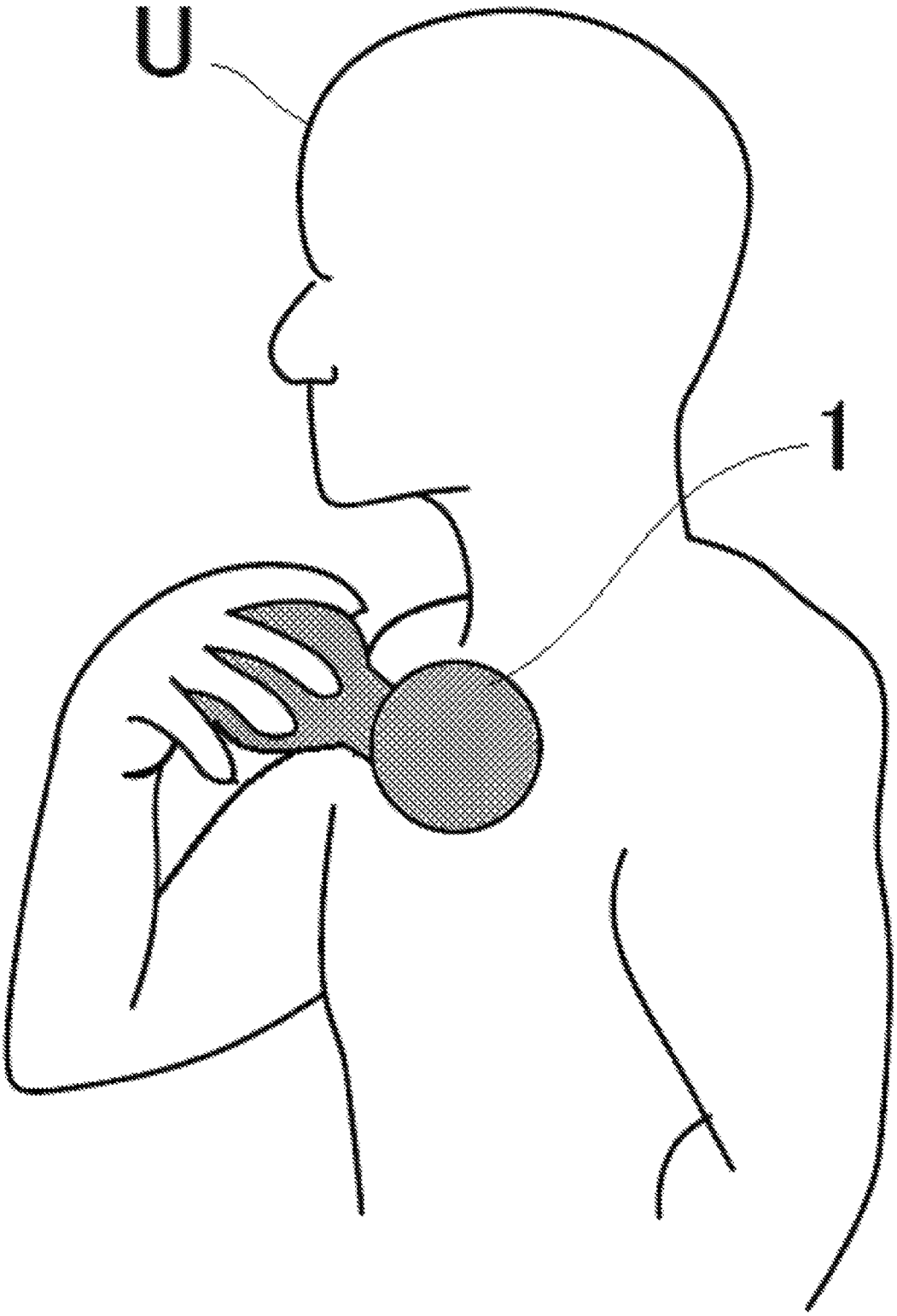
FIG. 6 is a view explaining another example of the usage state of the embodiment shown in FIG. 1.
Figure 7:
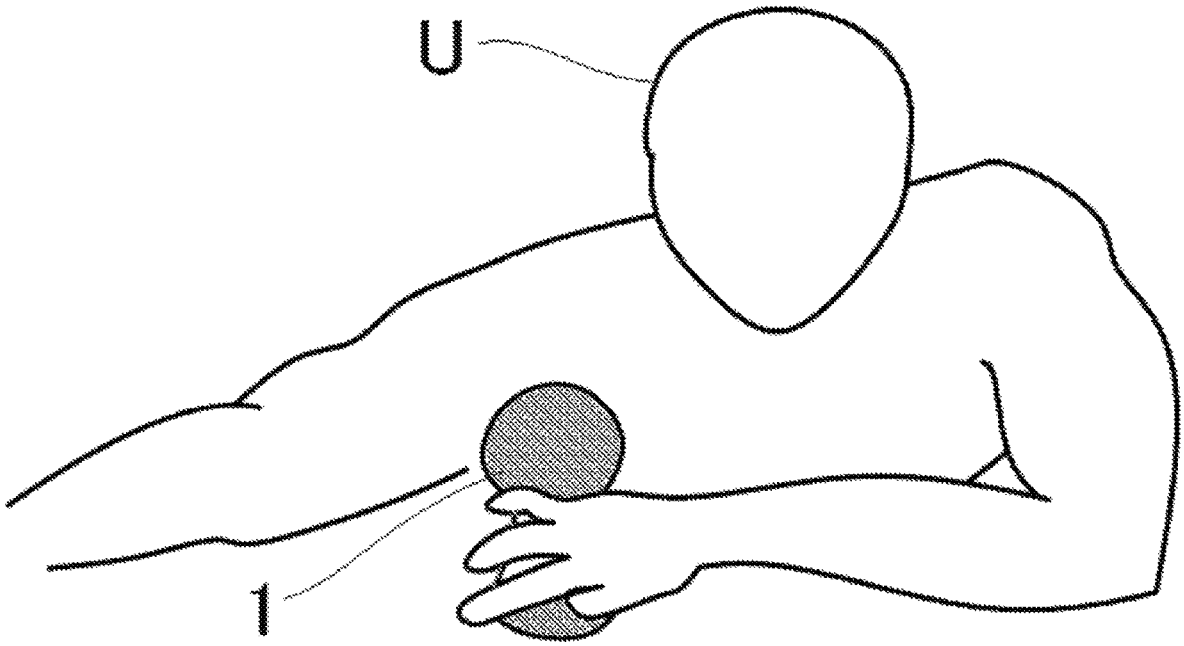
FIG. 7 is a view explaining further another example of the usage state of the embodiment shown in FIG. 1.
Figure 8:
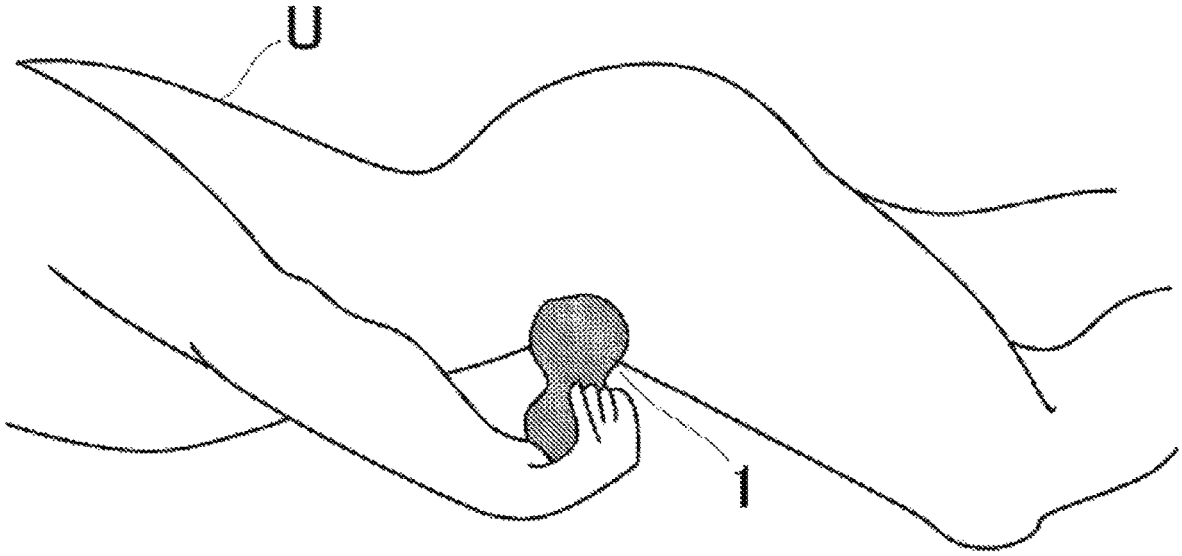
FIG. 8 is a view explaining further another example of the usage state of the embodiment shown in FIG. 1.
Figure 9A:
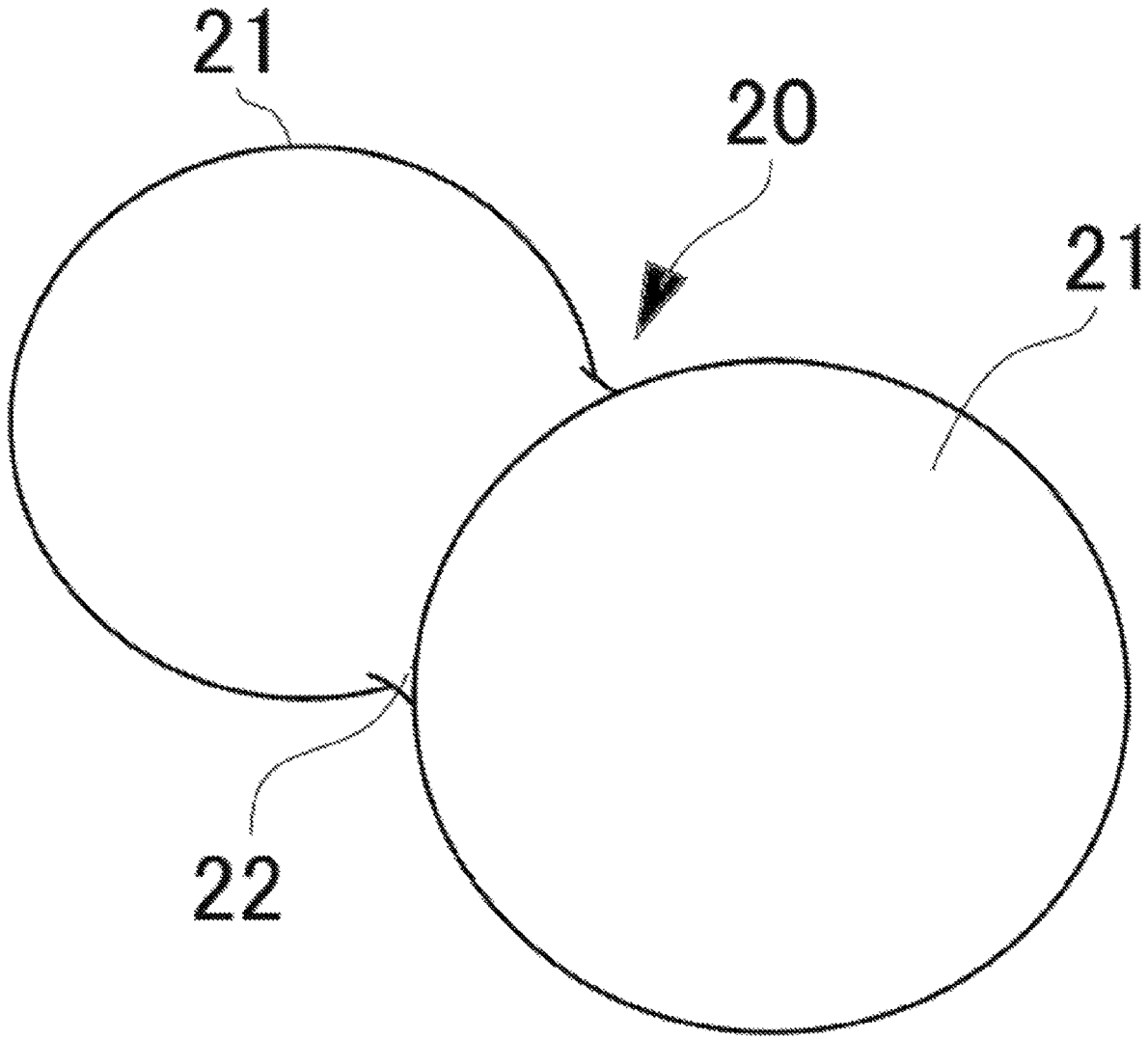
FIG. 9A is a perspective view showing an outer shape of a conventional stretching tool.
Figure 9B:
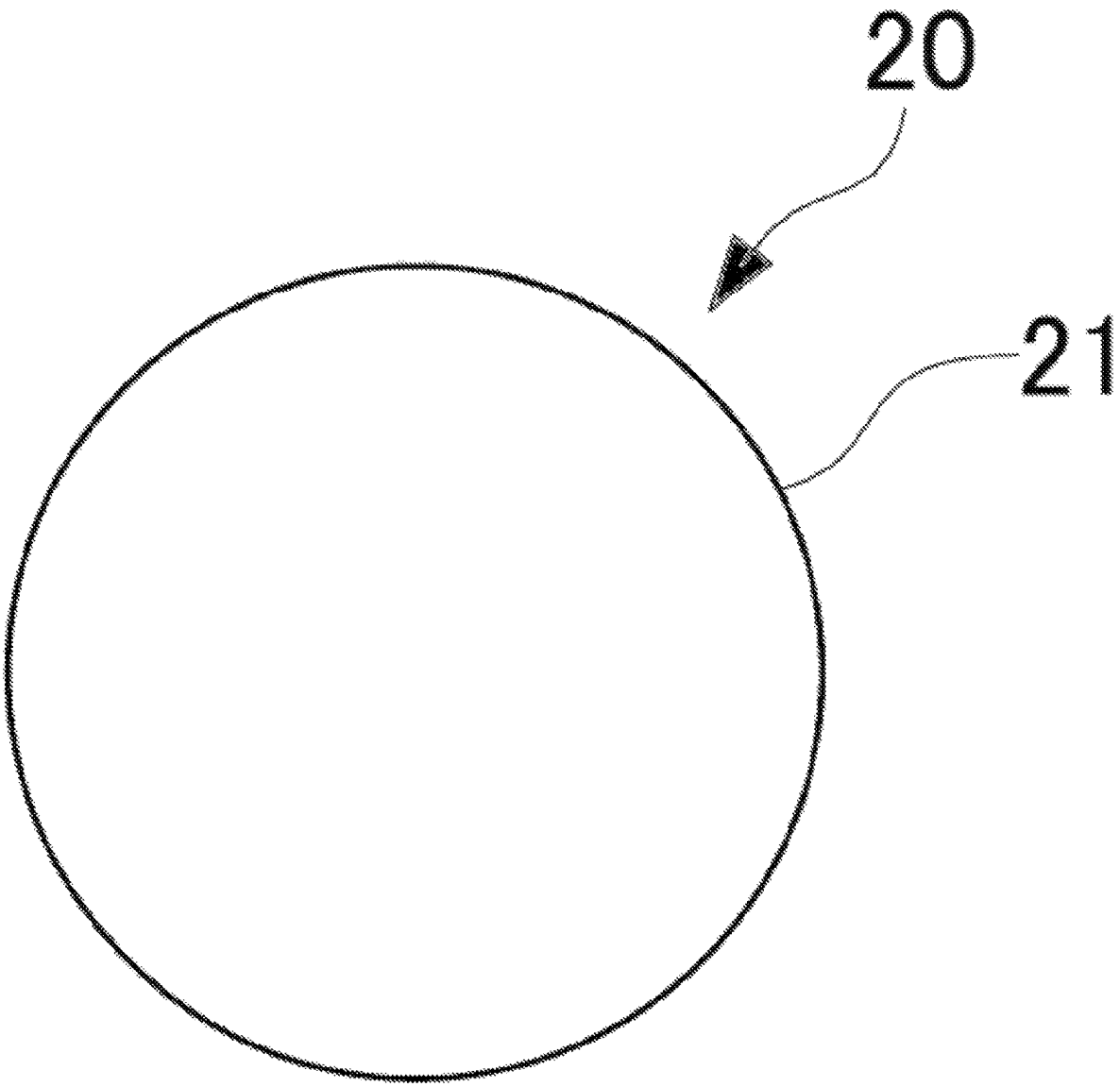
FIG. 9B is a side view of the stretching tool shown in FIG. 9A.
Figure 10A:
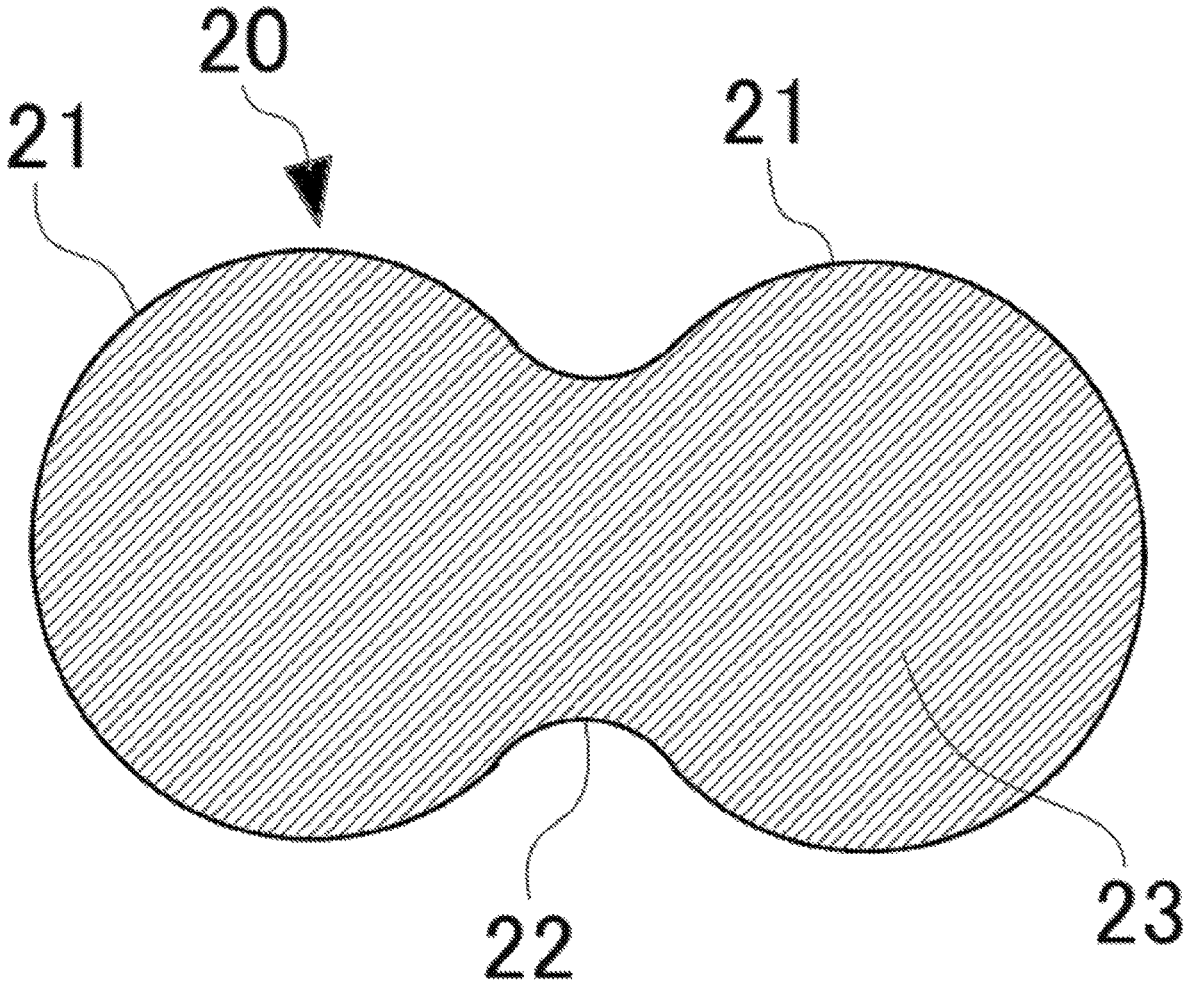
FIG. 10A is a sectional view showing an internal structure of one example of the conventional stretching tool.
Figure 10B:
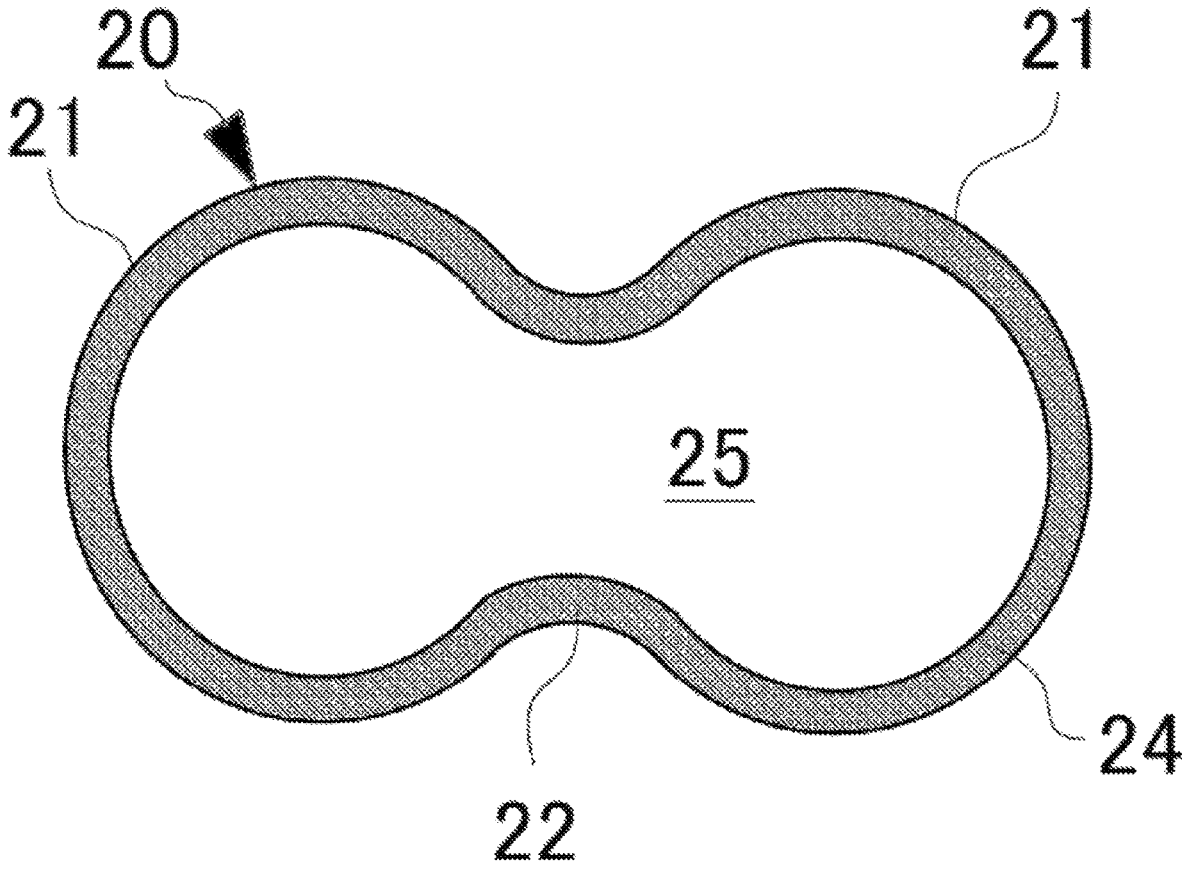
FIG. 10B is a sectional view showing an internal structure of another example of the conventional stretching tool.

Hereinafter, with reference to attached FIG. 1 to FIG. 4, one embodiment of a stretching tool of the present invention will be described in detail. FIG. 1 is a perspective view showing one embodiment of the stretching tool of the present invention. FIG. 2 is a front view of the embodiment shown in FIG. 1. FIG. 3 is a side view of the embodiment shown in FIG. 1. Furthermore, FIG. 4 is a sectional view showing an internal structure of the embodiment shown in FIG. 1.

The stretching tool 1 of the present embodiment includes two spherical bodies 2 of identical size, and a coupling portion 3. The size of each of the two spherical bodies 2 is not limited to specific one and may be defined such that its diameter is set to be within a range of 70 to 90 mm, preferably 75 to 85 mm. There are formed, on respective outer surfaces of the spherical bodies 2, multiple projecting lines 4 having a cross-section in a saw blade shape including peaks and troughs alternately arranged in the respective circumferential directions of the spherical bodies, and continuously extending toward the coupling portion 3 from respective outermost ends 7, 8 of the spherical bodies 2 located on the extending line of the axial center. In the present embodiment, as shown in FIG. 3, twelve projecting lines 4 are arranged on the outer surface of each spherical body 2, but the number of the projecting lines is not limited to this number and may be appropriately defined to any number within a range of 10 to 20. A height of the peak of each projecting line 4 may be appropriately defined within a range of 2 to 6 mm depending on the number of the projecting lines 4 and the hardness of an outer covering layer (see FIG. 4, reference numeral 12).

The multiple projecting lines 4 continuously extend toward the coupling portion 3, while being spirally curved in the clockwise direction when the spherical body 2 having the end 7 is seen from outside on the extending line of the axial center. In the spherical body 2 having the end 8, the multiple projecting lines 4 continuously extend toward the coupling portion 3, while being spirally curved in the counterclockwise direction. The respective curved directions of the projecting lines 4 provided on the respective outer surfaces of the two spherical bodies 2 are not limited to the aspect shown in FIG. 3; and for example, on the spherical body having the end 8, the projecting lines 4 may be curved in the clockwise direction. This means that the respective projecting lines 4 on the two spherical bodies 2 may be curved in the opposite directions to each other or may be curved in the same direction.

In each of the projecting lines 4 provided on the respective outer surfaces of the two spherical bodies 2, in the cross section in a saw blade shape including peaks and troughs alternately arranged in the circumferential direction of each spherical body 2, widths of two slope surfaces that form a peak are set to be different from each other. That is, in each projecting line 4, when each spherical body 2 is seen from outside on the extending line of the axial center, a slope surface 5 on the right side relative to the extending direction is set to be greater than a width of a slope surface 6 on the left side. With this configuration, when a user applies pressure onto the slope surface 5, the outer covering layer 12 sinks relatively deeper in the slope surface 5 than in the slope surface 6, and thus the user feels this softer; and when the user then applies pressure onto the slope surface 6, the outer covering layer 12 does not relatively sink, and due to a reaction force of this pressure, the slope surface 6 depresses an outer surface of the user's body. In this manner, by setting the respective slope surfaces to have different widths, when the user puts a part of his or her body on the tool and then rolls the tool back and forth, a difference in pressure occurs between the forward rolling and the backward rolling, which provides a massaging effect in combination of soft and strong pressures.

The two spherical bodies 2 are formed in a double structure including the respective inner shells 10 and the outer covering layers 12 that are in tight contact with respective surfaces of the inner shells 10 and have a relatively smaller hardness than that of the inner shells 10 so as to have elasticity. By employing such a double structure, it is possible to provide an advantageous effect exerting a gentle blood-circulation promotion without applying an excessive load onto skins, muscles, or joints.

A specific example of a material used for the inner shells 10 may include ABS resin, or the like. A specific example of a material used for the outer covering layers 12 may include polyurethane resin, polyvinylchloride resin, ethylene-vinyl acetate resin, etc.

A length ratio of a diameter R of each inner shell 10 relative to a thickness T of each outer covering layer 12 is defined to be variable, and both values can be suitably defined. If this length ratio is represented by a value of R/T, this value may be defined to approximately 5 to 7. As the value R/T approximates to 5, the length ratio of the thickness T of the softer outer covering layer 12 becomes large relative to the diameter R of the inner shell 10, which is likely to be easily accepted by a user who prefers smaller stimulation; and the user can also obtain a high stretching effect intensively on the fascia mainly present in a shallower region. As the value R/T approximates to 7, the thickness T of the softer outer covering layer 12 becomes small relative to the diameter R of the inner shell 10; and in the case in which a user uses the stretching tool 1 having this length ratio of R/T, stimulation to the deep fascia becomes stronger; therefore, this is more suitable for a user who needs stronger massaging on the deep fascia.

As aforementioned, with the projecting lines in a saw blade shape spirally provided on the respective outer surfaces of the two spherical bodies 2, when the user places a part of his or her body on the spherical bodies and rolls them on the part of the body, blood circulation can be promoted by rolling the spherical bodies so as to allow the outer covering layers 12 having moderate softness to gently depress the skin, to thereby stretch the shallow fascia with the respective projecting lines. Furthermore, when the user rolls the stretching tool over the skin by hand, while rubbing the skin with these projecting lines through turns of the wrist, the spiral shape helps to move the fascia under the subcutaneous fat inward or release this fascia outward, to thereby provide such an advantageous effect that further exerts an action of releasing adhesion or twist of the fascia. In addition, while the stretching tool 1 of the present embodiment is put in contact with the body, the body is moved back and forth to roll this stretching tool on the body, to thereby move the fascia under the subcutaneous fat inward by rolling in one direction and outward by rolling in the other direction, which provides an advantageous effect that exerts an action of further releasing adhesion or twist of the fascia.

In the present embodiment, the coupling portion 3 is configured to couple the inner shells 10 of the two spherical bodies 2 to each other with the axial center of the coupling portion 3 coinciding with a line connecting the respective centers of the two spherical bodies 2. In the present embodiment, as shown in FIG. 4, as in the case of the two spherical bodies 2, the coupling portion 3 is formed in a double structure including an inner-shell coupling portion 11; and an outer covering layer 13, and the inner-shell coupling portion 11 is coupled to the respective inner shells 10 of the two spherical bodies 2, and the outer covering layer 13 is coupled to the respective outer covering layers 12. The inner-shell coupling portion 11 in the above-configured coupling portion 3 can be formed of a material that is the same as or different from the material composing the inner shells 10 of the two spherical bodies 2. Similarly, the outer covering layer 13 of the coupling portion 3 may be formed of a material that is the same as or different material from the material composing the outer covering layers 12 of the two spherical bodies 2.

Inside the inner shells 10 of the two spherical bodies 2 and the coupling portion 3, a core member formed of a material that is the same as or different from the material composing the inner shells 10 may be disposed so as to extend through the respective centers of the inner shells 10 and the coupling portion 3 (a center connecting the respective centers of the inner shells 10 to the axial center of the inner-shell coupling portion 11). Here, the term "different" includes the case in which the material is identical, but a physical property thereof, such as density, is different. As this core member, various sectional shapes may be adopted, and a bar-shaped body or a pipe-shaped body (also including an annular-shaped body having a non-circular sectional shape) may also be used, for example. When a pipe-shaped body (or an annular-shaped body) is used, a hollow space is generated thereinside; therefore, such a hollow space may be provided. The core member is incorporated at the center so as to couple the two spherical bodies 2 (inner shells 10) together to be integrated; therefore, when pressure is applied onto the body by the stretching tool 1 of the present embodiment while the stretching tool 1 is held and vertically erected relative to the body, the entire shape of the stretching tool 1 of the present embodiment is not deformed, so that the stretching tool 1 can be pushed to depress further inner fascia (deeper fascia) in the body, thereby exerting a high stretching effect. Furthermore, it is suitable for stretching by applying pressure to depress a region of the body, particularly the armpit, the groin region, or the like.

Next, with reference to FIG. 5 to FIG. 8, a method of using the stretching tool of the present embodiment will be described. A user U puts the stretching tool 1 of the present embodiment on the floor or between the body and the wall to be in contact with a part of the body, and then applies his or her weight to the stretching tool 1 to apply pressure onto the body; alternately, the user U applies pressure to the body while holding the stretching tool 1 in the hand and putting this stretching tool 1 on a part of the body (see FIGS. 6 to 8). By rolling the stretching tool 1 back and forth while applying the user U's weight onto the stretching tool 1 (see FIG. 5), the peaks having the slope surfaces with different widths in the projecting lines provided on the outer surfaces of the spherical bodies 2 are pushed to depress the body, while being rolled to pressurize the fascia, to thereby perform the stretching.

In addition, the stretching tool 1 of the present embodiment can be used at various body regions of the user U, such as the armpit, a region between the shoulder and the chest, and the groin region. In this case, by putting the stretching tool 1 of the present embodiment on the above body regions with the stretching tool 1 erectly held, the user U can perform the stretching while pressing the fascia present in a deeper region. The presence of the inner shells 10 in the double structure of the spherical bodies 2 keeps the stretching tool 1 in shape without being deformed; and in addition, because of the presence of the outer covering layers 12, soft touching to the skins with small hardness as well as elasticity allows the user U to use the stretching tool 1 without feeling a sense of pain.

REFERENCE SINGS LIST

1 stretching tool of the present embodiment
2 spherical body
3 coupling portion
4 projecting line
5 slope surface
6 slope surface
7, 8 end
10 inner shell
11 inner-shell coupling portion
12, 13 outer covering layer
U user

The invention claimed is:

1. A stretching tool comprising:

two spherical bodies of identical size, formed in a double structure including inner shells and outer covering layers in tight contact with respective surfaces of the inner shells, the outer covering layers having a relatively smaller hardness than that of the inner shells so as to have elasticity; and a coupling portion extending between and interconnecting the spherical bodies, wherein:

the two spherical bodies have multiple projecting sections thereon defining projecting ridges of the same shapes on their surfaces, the projecting sections having a cross section in a saw blade shape including peaks and troughs alternately arranged in respective circumferential directions of the spherical bodies and continuously extending toward the coupling portion from respective outermost ends of the spherical bodies in the direction of an extending line of the axial center, the projecting ridges converging toward a common point at the outermost end of each of the spherical bodies, respectively, such that the ridges are adjoined to one another at said outermost end, and the coupling portion is formed of a material that is the same as or different from a material of the inner shells, and the coupling portion couples the inner shells to each other such that an axial center of the coupling portion coincides with a line connecting respective centers of the two spherical bodies.

2. The stretching tool according to claim 1, wherein a ratio between a diameter of the inner shell and a thickness of the outer covering layer of each spherical body is variable.

3. The stretching tool according to claim 1, wherein, when each spherical body is seen from outside on the extending line of the axial center, the multiple projecting ridges continuously extend toward the coupling portion while being spirally curved in a clockwise direction or a counterclockwise direction.

4. The stretching tool according to claim 3, wherein the multiple projecting ridges are formed to be curved in the clockwise direction on an outer surface of one of the two spherical bodies, and to be curved in the counterclockwise direction on an outer surface of another of the two spherical bodies.

5. The stretching tool according to claim 1, wherein the coupling portion also includes an outer covering layer.

6. The stretching tool according to claim 1, wherein a core member is disposed at a center so as to connect respective centers of the inner shells of the spherical bodies to the axial center of the coupling portion, the core member being formed of a material that is the same as or different from a material of the inner shells.

7. A stretching tool comprising:

first and second spherical bodies of identical size, formed in a double structure including inner shells and outer covering layers in tight contact with respective surfaces of the inner shells, the outer covering layers having a relatively smaller hardness than that of the inner shells so as to have elasticity; and a coupling portion extending between and interconnecting the spherical bodies, wherein:

the two spherical bodies have multiple projecting sections thereon defining projecting ridges of the same shapes on their surfaces, the projecting sections having a cross section in a saw blade shape including peaks and troughs alternately arranged in respective circumferential directions of the spherical bodies, respectively, and continuously extending toward the coupling portion from respective outermost ends of the spherical bodies in the direction of an extending line of the axial center, the projecting ridges converging toward a common point at the outermost end of each of the spherical bodies, such that the ridges are adjoined to one another at said outermost end each of the projecting sections on the first spherical body is substantially identical to all of the other projecting sections thereon, and each of the projecting sections on the second spherical body is substantially identical to all of the other projecting sections thereon, the coupling portion is formed of a material that is the same as or different from a material of the inner shells, and the coupling portion couples the inner shells to each other such that an axial center of the coupling portion coincides with a line connecting respective centers of the two spherical bodies, and wherein in each of the projecting sections, widths of two slope surfaces, that cooperate to form a peak, are different from each other.

8. The stretching tool according to claim 7, wherein, when each spherical body is seen from outside on the extending line of the axial center, the multiple projecting ridges continuously extend toward the coupling portion while being spirally curved in a clockwise direction or a counterclockwise direction.

9. The stretching tool according to claim 8, wherein the multiple projecting ridges are formed to be curved in the clockwise direction on an outer surface of the first spherical body, and to be curved in the counterclockwise direction on an outer surface of the second spherical body.

* * * * *